United States Patent [19]

Maes

[11] 3,980,027

[45] Sept. 14, 1976

[54] DISPLAY TABLE FOR ORNAMENTAL OBJECTS

[75] Inventor: Charles-Henri Marie Maës, Paris, France

[73] Assignee: Oreevrert D'Ercuis, Paris, France

[22] Filed: Oct. 29, 1974

[21] Appl. No.: 518,804

[30] Foreign Application Priority Data

Nov. 5, 1973 France ..... 73.39190

[52] U.S. Cl. ..... 108/103; 108/139

[51] Int. Cl.[2] ..... A47B 11/00

[58] Field of Search ..... 108/103, 139, 150, 104, 108/94; 312/125, 252, 197, 202, 120; 211/131, 163

[56] References Cited

UNITED STATES PATENTS

| | | | |
|---|---|---|---|
| 231,478 | 8/1880 | Curry | 312/125 |
| 1,054,617 | 2/1913 | Regamey | 108/104 |
| 1,213,026 | 1/1917 | Sande | 108/103 |
| 1,611,179 | 12/1926 | Fisher | 211/131 |
| 1,844,040 | 2/1932 | Lawrenz | 108/150 |
| 2,141,001 | 12/1938 | Horsley | 108/139 |
| 3,437,057 | 4/1969 | Wulff | 108/94 |

*Primary Examiner*—Ramon S. Britts
*Assistant Examiner*—Darrell Marquette
*Attorney, Agent, or Firm*—Darby & Darby

[57] ABSTRACT

The invention provides a display table for simultaneously displaying various kinds of ornamental objects, particularly objects which are designed to decorate a table. The display table comprises a circular central panel, an outer panel concentric with and mounted for rotation about the central panel, and a storage space situated under the outer panel.

4 Claims, 4 Drawing Figures

DISPLAY TABLE FOR ORNAMENTAL OBJECTS

FIELD OF THE INVENTION

This invention relates to a display table designed for simultaneously displaying different kinds of tableware, silverware, glassware and other ornamental objects intended to decorate a table.

SUMMARY OF THE INVENTION

According to the invention there is provided a table for displaying articles, comprising a central panel, an outer panel concentric with and mounted for rotation about the central panel and a storage space situated underneath the outer panel.

In an embodiment of the display table according to the invention, the central panel is supported by a cylindrical column equipped with storage shelves.

The outer, rotary panel may if desired be made of glass or another transparent material.

DETAILED DESCRIPTION OF ILLUSTRATED EMBODIMENTS

Figure 1:
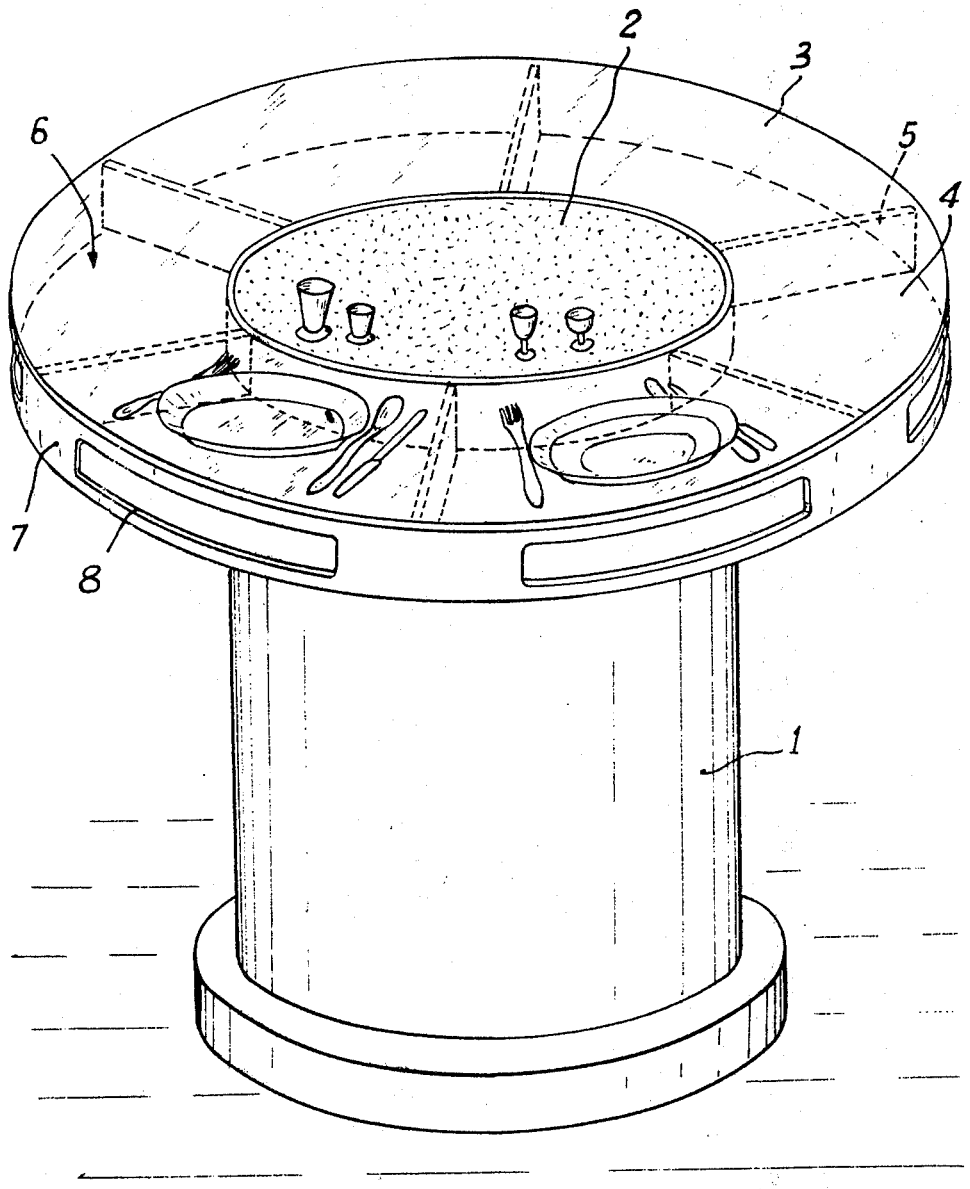
FIG. 1 is a perspective view of a table according to the invention.

The table illustrated comprises a pedestal 1 in the form of a cylindrical column which supports a fixed, central panel 2. A movable panel 3 made of glass or another transparent material is mounted for rotation about the fixed central panel 2.

The panel 3 may be integral with an identical panel 4, a plurality of vertical walls or partitions 5 being arranged between the panels 3 and 4 to define storage compartments 6.

Alternatively, as illustrated, a cylindrical ring 7 can be arranged between the panels 3 and 4 to close the compartments 6, the ring 7 comprising an opening 8 for each storage compartment 6.

In a modified form of the invention, the vertical partitions 5 are omitted and the space between the upper panel 3, the lower panel 4 and the ring 7 defines a storage space completely encircling the table under the panel 3.

The movable panel 3 and the storage compartments 6 are rotatably mounted on the pedestal 1.

In the embodiment illustrated, the panel 3 is transparent although the panel 3 may instead be opaque.

Figure 2:
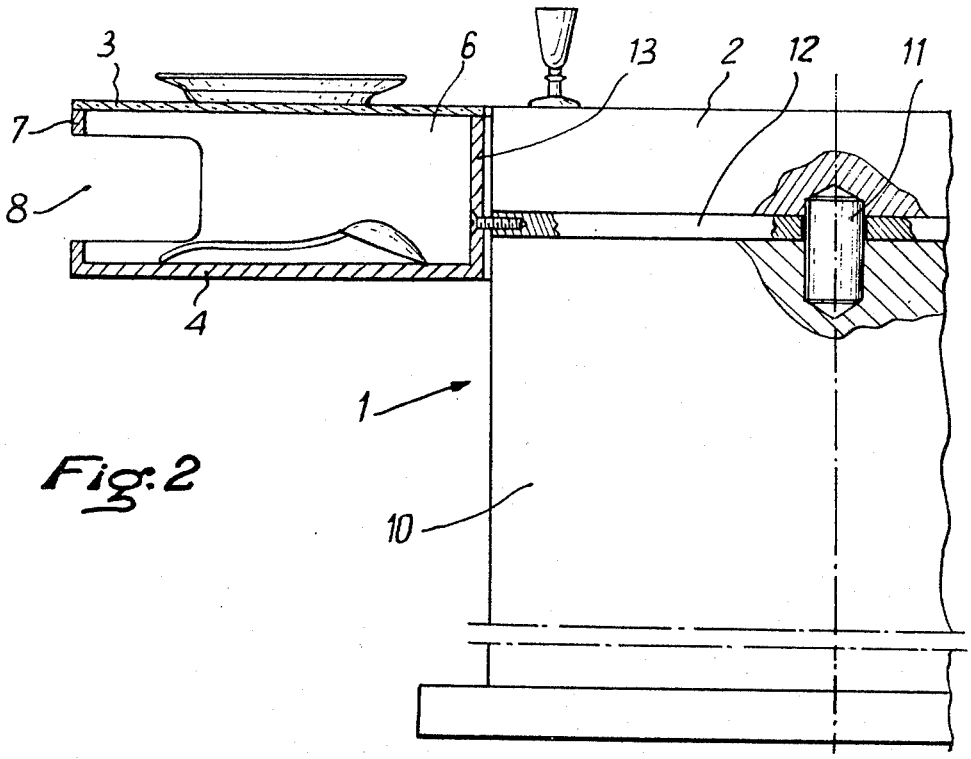
FIG. 2 is a view, partly in section, of the table shown in FIG. 1.

In the view shown in FIG. 2, the pedestal 1 comprises a base 10 which, at its centre, carries a shaft 11. On the shaft 11 there is rotatably mounted a disc 12 to whose periphery is fixed a cylindrical ring 13 to which the panels 3 and 4 are connected, the panel 4 supporting the cylindrical ring 7.

Figure 3:
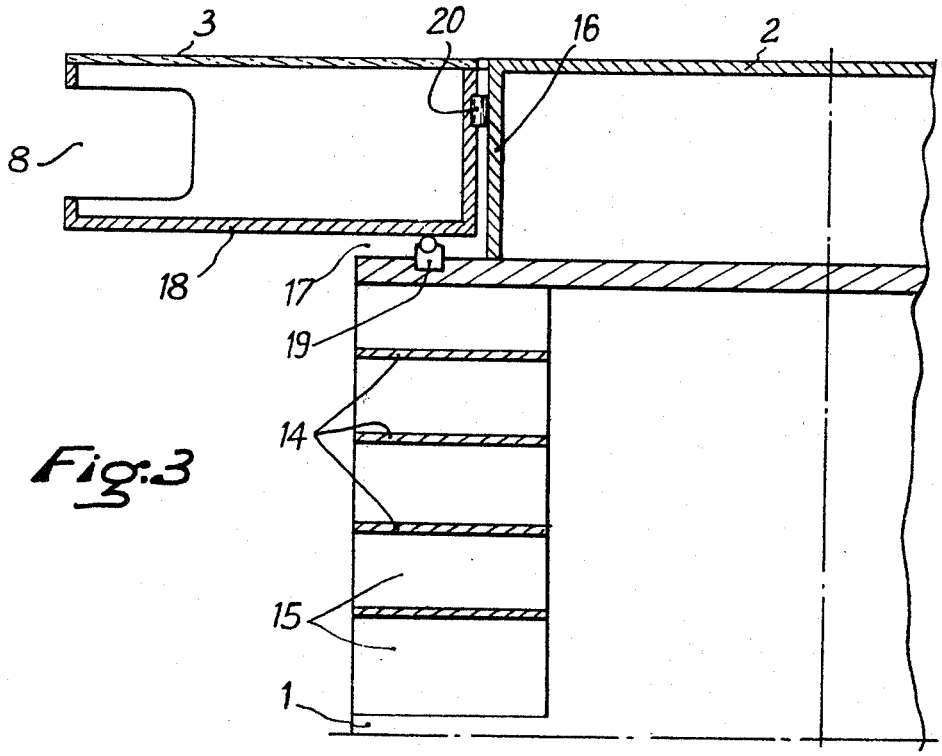
FIG. 3 is a view, partly in section, of a modified embodiment.

In the embodiment shown in FIG. 3 the pedestal 1 comprises a plurality of shelves 14 defining storage compartments 15. At the top of the pedestal 1 there is a cylindrical framework 16 whose upper wall forms the fixed central panel 2, this framework being slightly smaller in diameter than the pedestal 1, resulting in the formation of a shoulder 17 between the pedestal 1 and the framework 16.

The outer panel 3 is of transparent material and rest on an annular framework 18 which may be divided up into several storage compartments by partitions similar to the partitions 5, openings 8 being provided.

The framework 18 is fitted on to the framework 16 and rests on a ball bearing track 19 accommodated in the shoulder 15. The framework 18 is centered by a ring 20 of needle bearings.

The embodiments illustrated in FIGS. 2 and 3 are purely illustrative and are by no means intended to limit the invention. For instance, the outer panel may be rotatably mounted on the inner panel by any other suitable means.

This table is particularly advantageous for showing sets of tableware, glassware, silverware or the like to customers.

Glasses of different kinds can be displayed on the central panel 2, whilst an equal number of plates of different kinds can be arranged on the movable outer panel. The cutlery is accommodated in the storage compartment or compartments 6. By turning the outer panel 3, the retailer is able successively to show each plate before each set of glasses, and the customer is able to see the various possible combinations without having to handle the glassware, cutlery and plates.

Figure 4:
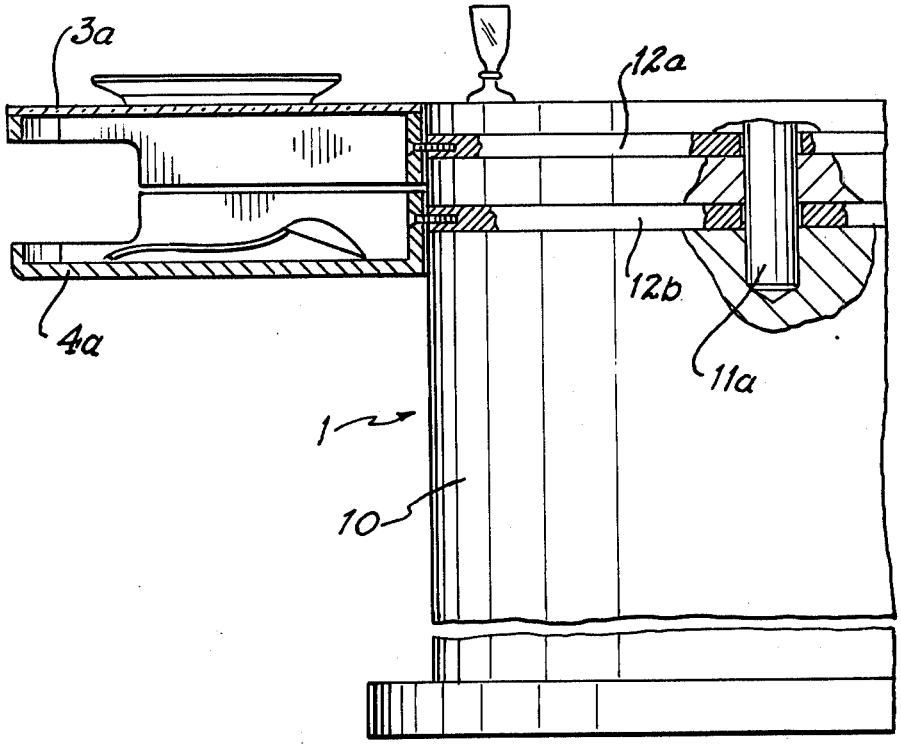
FIG. 4 is a view, partly in section, of a further embodiment of the invention.

In another modified embodiment shown in FIG. 4, the panel **4*a* is rotatable as well as the panel 3*a*, independently thereof on respective discs 12*a* and 12*b* about shaft 11*a*. This arrangement is similar to that of FIG. 2. Thus, it is possible by turning either the panel 3*a* or the panel 4*a* and hence the compartments 5,** or both, to go through all the various possible combinations very quickly without any need for handling, thus enabling the customer to see the particular combination he or she is seeking.

The present invention is particularly intended to serve as a display facility for articles of glass and crystal, although obviously it may be used for showing other articles.

I claim:

1. A table for displaying several articles in different set arrangements comprising:

a central pedestal having a horizontal generally circular upper member on which one or more first articles can be displayed, an annular member surrounding the upper portion of said pedestal, said annular member including an annular upper disc of transparent material on which one or more second articles can be displayed, said upper disc being mounted horizontally at substantially the same level as said upper member of said pedestal and extending outwardly of the outer periphery of said pedestal, said annular member also including a lower disc spaced below the upper disc and extending outwardly of the outer periphery of said pedestal to form a storage space therebetween so that one or more third articles can be displayed on said lower disc and seen through said upper disc, and means for mounting at least one of said upper and lower discs of said annular member to rotate about said pedestal to permit the display of different ones of second and third articles relative to a first article.

2. A table for displaying articles as in claim 1 wherein said lower disc of said annular member is connected to said upper transparent disc to rotate with it.

3. A table for displaying articles as in claim 1 further comprising storage compartments mounted on said pedestal.

4. A table as in claim 1 wherein said upper and lower discs are separated from each other and said mounting means permits rotation of said upper and lower discs relative to each other.

* * * * *